US010260159B2

(12) United States Patent
Woodrow, III et al.

(10) Patent No.: US 10,260,159 B2
(45) Date of Patent: Apr. 16, 2019

(54) METHODS AND APPARATUSES FOR MITIGATING TIN WHISKER GROWTH ON TIN AND TIN-PLATED SURFACES BY DOPING TIN WITH GOLD

(71) Applicant: The Boeing Company, Chicago, IL (US)

(72) Inventors: Thomas A. Woodrow, III, Lakeside, TX (US); Jean A. Nielsen, Kent, WA (US)

(73) Assignee: THE BOEING COMPANY, Chicago, IL (US)

( * ) Notice: Subject to any disclaimer, the term of this patent is extended or adjusted under 35 U.S.C. 154(b) by 219 days.

(21) Appl. No.: 13/935,832

(22) Filed: Jul. 5, 2013

(65) Prior Publication Data

US 2015/0008131 A1 Jan. 8, 2015

(51) Int. Cl.

*C25D 3/60* (2006.01)
*C25D 3/30* (2006.01)
*C25D 3/48* (2006.01)

(52) U.S. Cl.

CPC ..... *C25D 3/60* (2013.01); *C25D 3/30* (2013.01); *C25D 3/48* (2013.01)

(58) Field of Classification Search

CPC ..... C25D 3/48; C25D 3/60; C25D 3/62
USPC ..... 205/247, 238, 252, 253
See application file for complete search history.

(56) References Cited

U.S. PATENT DOCUMENTS 3,764,489 A * 10/1973 Zutini et al. ..... 205/247
4,013,523 A * 3/1977 Stevens ..... C25D 3/62 205/247
4,310,392 A * 1/1982 Kohl ..... C25D 3/02 205/238
4,959,278 A 9/1990 Shimauchi et al.
5,393,573 A 2/1995 MacKay
5,750,017 A 5/1998 Zhang
6,245,208 B1 * 6/2001 Ivey ..... C25D 3/62 205/247
6,361,823 B1 3/2002 Bokisa et al.
6,860,981 B2 3/2005 Schetty, III et al.
7,160,629 B2 1/2007 Crosby
7,391,116 B2 6/2008 Chen et al.
7,604,871 B2 10/2009 Jackson et al.
7,641,944 B2 * 1/2010 Ichimura et al. ..... 427/553
8,329,248 B2 12/2012 Jackson et al.

(Continued)

FOREIGN PATENT DOCUMENTS

JP 50045296 A * 4/1975 ..... C22C 5/02
JP S61 15992 A 1/1986

(Continued)

OTHER PUBLICATIONS

Watt et al., "A Simple Process for Electrodeposition of Sn-rich, Au—Sn Solder Films," J Mater Sci: Mater Electron (no month, 2013), vol. 24, pp. 827-837.*

(Continued)

*Primary Examiner* — Edna Wong

(74) *Attorney, Agent, or Firm* — MH2 Technology Law Group LLP

(57) ABSTRACT

The present disclosure generally relates to the field of tin electroplating. More specifically, the present disclosure relates to methods for mitigating tin whisker formation on tin-plated films and tin-plated surfaces by doping the tin with gold.

18 Claims, 7 Drawing Sheets

(56) References Cited

U.S. PATENT DOCUMENTS

| | | | | |
|---|---|---|---|---|
| 2002/0192492 | A1 | 12/2002 | Abys et al. | |
| 2006/0096867 | A1* | 5/2006 | Bokisa et al. | 205/253 |
| 2007/0007144 | A1 | 1/2007 | Schetty, III | |
| 2007/0295530 | A1 | 12/2007 | Jackson et al. | |
| 2008/0050611 | A1 | 2/2008 | Kwok et al. | |
| 2011/0020664 | A1* | 1/2011 | Mitose | C25D 5/12 428/576 |

FOREIGN PATENT DOCUMENTS

| | | | | |
|---|---|---|---|---|
| JP | 10-060682 | | 3/1998 | |
| JP | 2009185358 | A * | 8/2009 | C25D 3/32 |
| JP | 2009-263786 | A | 11/2009 | |
| WO | WO 99/06612 | | 2/1999 | |
| WO | WO 2004001101 | A2 * | 12/2003 | C25D 3/02 |
| WO | WO-2004001101 | A2 * | 12/2003 | C25D 3/02 |
| WO | WO 2005/118917 | A1 | 12/2005 | |

OTHER PUBLICATIONS

He et al., "Electrodeposition of Au—Sn Alloys for Lead-free Solders: Au-rich Eutectic and Sn-rich Eutectic Compositions," In Advanced Packaging Materials (APM), 2013 IEEE International Symposium (Feb. 2013), pp. 52-68.*

Cardoso et al., "Electrodeposition of Au—Sn Alloys from a Modified Non-Cyanide Bath," ECS Transactions (no month, 2009), vol. 23, No. 1, pp. 85-92.*

Cardoso et al., "Electrodeposition of Au-Sn Alloys from a Modified Non-Cyanide Bath," ECS Transactions (no month, 2009), vol. 23, No. 1, pp. 85-92. (Year: 2009).*

Cardoso et al., "Electrodeposition of Au-Sn Alloys from a Modified Non-Cyanide Bath," ECS Transactions (2009), vol. 23, No. 1, pp. 85-92. (Year: 2009).*

Zhang, Yahui and Ivey, Douglas G., Phase Formation in Gold-Tim Alloys Electroplated from a Non-cyanide Bath, 2003 International Conference on Compound Semiconductor Mfg.

Arnold, S.M., Repressing the Growth of Tin Whiskers, Plating, Jan. 1966, pp. 96-99.

International Search Report and Written Opinion dated Sep. 12, 2014 for PCT/US2014/035890, 12 pages.

Arnold, "Repressing the Growth of Tin Whiskers," Plating and Surface Finishing, American Electroplaters Society, Inc., Jan. 1966, pp. 96-99.

S.M. Arnold, "Repressing the Growth of Tin Whiskers," Plating, vol. 53, 1966, pp. 96-99.

Boeing Invention Disclosure, Tin Antimony Platings for Whisker Mitigation, Apr. 7, 2011, 13 pages.

S.C. Britton, "Spontaneous Growth of Whiskers on Tin Coatings: 20 Years of Observation", Transactions of the Institute of Metal Finishing, vol. 52, 1974, pp. 95-102.

J.A. Brusse, G.J. Ewell, and J.P. Siplon, "Tin Whiskers: Attributes and Mitigation", 22nd Capacitor and Resistor Technology Symposium Proceedings, Mar. 25-29, 2002, pp. 67-80.

K.M. Cunningham and M.P. Donahue, "Tin Whiskers: Mechanism of Growth and Prevention", 4'h International SAMPE Electronics Conference Proceedings, Jun. 12-14, 1990, p. 569-575.

B.D. Dunn, "Whisker Formation on Electronic Materials", Circuit World, vol. 2 No. 4, Jul. 1976, pp. 32-40.

D. Endicott and K.T. Kisner, "A Proposed Mechanism for Metallic Whisker Growth", Proceedings of the AESF SUR/FIN Conference, Jul. 1984, pp. 1-20.

M. Endo, S. Higuchi, Y. Tokuda and Y. Sakabe, "Elimination of Whisker Growth on Tin Plated Electrodes", Proceedings of the 23'd International Symposium for Testing and Failure Analysis, Oct. 27-31, 1997, pp. 305-311.

K. Fujiwara, M. Ohtani, T. Isu, S. Nango, R. Kawanaka, and K. Shimizu, "Interfacial Reaction in Bimetallic Sn/Cu Thin Films", Thin Solid Films, vol. 70, 1980, pp. 153-161.

N. Furuta and K. Hamamura, "Growth Mechanism of Proper Tin-Whisker", Journal of Applied Physics, vol. 8, No. 12, Dec. 1969, pp. 1404-1410.

Dr. G.T. Galyon, "Annotated Tin Whisker Bibliography", NEMI, Feb. 2003, pp. 1-21.

V.K. Glazunova and N.T. Kudryavtsev, "An Investigation of the Conditions of Spontaneous Growth of Filiform Crystals on Electrolytic Coatings", J. of Applied Chemistry of the USSR (translated from Zhurnal Prikladnoi Khimii), vol. 36, No. 3, Mar. 1963, pp. 519-525.

P. Harris, "The Growth of Tin Whiskers", ITRI Booklet No. 734, 1994, pp. 1-19.

T. Kakeshita, K. Shimizu, R. Kawanaka and T. Hasegawa, "Grain Size Effect of Electro-Plated Tin Coatings on Whisker Growth", Journal of Materials Science, vol. 17, 1982, pp. 2560-2566.

R. Kawanaka, K. Fujiwara, S. Nango and T. Hasegawa, "Influence of Impurities on the Growth of Tin Whiskers", Japanese Journal of Applied Physics, Part I, vol. 22, No. 6, Jun. 1983, pp. 917-922.

P.L. Key, "Surface Morphology of Whisker Crystals of Tin, Zinc and Cadmium", IEEE 20th Electronic Components Conference Proceedings, May 1970, pp. 155-160.

B. -Z. Lee and D.N. Lee, "Spontaneous Growth Mechanism of Tin Whiskers", Acta Metallurgica, vol. 46, No. 10, Jun. 1998, pp. 3701-3714.

Lindborg, U., "A Model for the Spontaneous Growth of Zn, Cd, and Sn Whiskers," Acta Metallurgica, vol. 24, No. 2, Feb. 1976, pp. 181-186.

Capt. M.E. McDowell, "Tin Whiskers: A Case Study", Aerospace App. Cont., 1993, pp. 207-215.

N.A.J. Sabbagh and H.J. McQueen, "Tin Whiskers: Causes and Remedies", Metal Finishing, Mar. 1975, pp. 27-31.

M. Sampson, ed. "Whisker Failures." NASA Tin Whisker Homepage. NASA, Aug. 3, 2009. Web. Feb. 9, 2013. <http://nepp.nasa.gov/WHISKER/failures/index.htm>, 4 pages.

A. Selcuker and M. Johnson, "Microstructural Characterization of Electrodeposited Tin Layer in Relation to Whisker Growth", Capacitor and Resistor Technology Symposium Proceedings, Oct. 1990, pp. 19-22.

T. Woodrow, B. Rollins, P. Nalley and B. Ogden, "Tin Whisker Mitigation Study: Phase I. Evaluation of Environments for Growing Tin Whiskers", Electronic Material and Processes (EM/P) Report-576, Project I 0: CBTP-05 1-010-5 132, The Boeing Company, Aug. 1, 2003, 140 pages.

L. Zakraysek, et.al., "Whisker Growth from a Bright Acid Tin Electrodeposit", Plating and Surface Finishing, vol. 64, No. 3, Mar. 1977, pp. 38-43.

Yahui Zhang and Douglas G. Ivey, "Phase Formation in Gold-Tin Alloys Electroplated from a Non-cyanide Bath", 2003 Conference on Compound Semiconductor Manufacturing, 2003, 4 pages.

International Preliminary Report on Patentability; dated Jan. 5, 2016 for PCT/US2014/035890 . . . , 7 pages Jan. 5, 2016.

He, A. et al., "Development of stable, non-cyanide solutions for electroplating Au—Sn alloy films", Journal of Materials Science: Materials in Electronics, vol. 17, 2006, pp. 63-70.

English translation of the Notification of the Decision of Final Rejection dated Feb. 6, 2018 in corresponding Chinese Application No. 201480037943.X.

"Office Action dated May 24, 2018," for corresponding Japanese Application No. 2016-523734.

* cited by examiner

METHODS AND APPARATUSES FOR MITIGATING TIN WHISKER GROWTH ON TIN AND TIN-PLATED SURFACES BY DOPING TIN WITH GOLD

STATEMENT OF GOVERNMENT RIGHTS

This invention was made with Government support under Contract Number W912HQ-10-C-0022 awarded by the U.S. Department of Defense. The U.S. Government has certain rights in this invention.

TECHNOLOGICAL FIELD

The present disclosure generally relates to the field of tin electroplating. More specifically, the present disclosure relates to methods for mitigating tin whisker formation on tin-plated films and tin-plated surfaces by doping the tin with gold.

BACKGROUND

The worldwide transition to lead-free electronics is forcing most major suppliers of electronic components to convert their product lines from tin/lead-containing finishes to lead-free finishes. As a result, most electronics suppliers have moved to pure electroplated tin finishes. However, there is a tendency of electroplated pure tin finishes to form tin whiskers that extend a distance from the surface. Such tin whiskers have been found to form on a wide variety of tin-plated components, and under a wide range of environmental conditions. Since these tin whiskers are comprised of nearly pure tin and are therefore electrically conductive, they can cause problems, such as, for example, shorting of electronic components. Therefore the growth of tin whiskers from tin-plated surfaces continues to cause reliability issues and other problems for electronic systems that use tin-plated components. Undesirable effects attributable to tin whisker formation on tin-plated surfaces have caused significant customer dissatisfaction resulting in significant financial impact on electronics manufacturers. To date, the only way to ensure that tin whiskers do not grow within an electronic system is to eliminate pure tin from such a system. However, the increasing reliance on the use of tin and tin-plated components in the electronic industry makes this tin elimination strategy unworkable. For example, a tin coating on components helps to protect the components from corrosion. Tin coatings also help to provide a suitable surface for soldering.

One tin whisker mitigation strategy has been to immerse all tin-plated component leads into molten tin/lead, from the tip of the lead up to the component body. However, this process can undesirably affect the component and is expensive to implement into the manufacturing process. Other systems have tried immersion plating or otherwise providing a metallic or non-metallic overcoat to tin surfaces. However, no known methods have provided predictable long-term economical, reproducible and scalable solutions to the eventual and undesirable whisker formation on tin-plated surfaces.

BRIEF SUMMARY

According to one variation, the present disclosure relates to a method for mitigating tin whisker growth on a substrate surface comprising the steps of providing a substrate surface; providing a solution comprising an amount of a gold-containing compound and a tin-containing compound and at least one appropriate complexing agent, and a buffer; and immersing electrodes into the solution with the electrodes connected to an electrical power source capable of providing an electrical current to the electrodes, resulting in co-depositing a controlled amount of gold and tin onto the substrate surface. The systems, methods and apparatuses of the present disclosure could also be used and incorporated into systems and methods using a three electrode system with the third electrode being a reference electrode.

The gold-containing compound provided to the first solution is preferably a water soluble gold salt, such as, for example, sodium tetrachloroaurate. An amount of sodium sulfite is preferably provided as a complexing agent to complex the gold in the first solution. In addition, an amount of a complexing agent to complex the tin is added, such as, for example 1-ascorbic acid. An amount of buffer, such as, for example, triammonium citrate is dissolved in water to form the second solution to which the tin-containing compound is added. The tin-containing compound provided to the second solution is preferably a water-soluble tin-containing salt, such as, for example, tin (II) chloride. An amount of non-ionic surfactant/leveling agent (e.g. Triton X-100, etc.) is preferably then added to the first or second solution. Once the first and second solutions are combined to form the third electrolyte solution, containing gold and tin ions, an amount of surfactant/leveling agent, preferably a phenolphthalein solution, is added to the third solution. The third solution is preferably maintained at a pH of about 5.4.

According to a further variation, the cathodic substrate surface comprises copper, a commonly used material for electronic components such as, for example, leads. Preferably, controlled amounts of gold and tin are co-deposited onto the substrate surface to a thickness of from about 1 to about 10 microns, with a gold concentration of from about 0.5 to about 5 weight percent, and more preferably from about 1 to about 2 weight percent.

The present disclosure also relates to a method for making an electroplating bath comprising, in a first solution, dissolving an amount of gold-containing compound (preferably sodium tetrachloroaurate) in water (preferably deionized water) and adding an amount of a first and second complexing agent (preferably sodium sulfite and 1-ascorbic acid). In a second solution, an amount of a triammonium citrate buffer is dissolved in water (preferably deionized water) to which is added an amount of water-soluble tin-containing compound (preferably tin (II) chloride), and optionally an amount of a non-ionic surfactant/leveling agent. The first and second solutions are combined to make a third solution, to which is added an amount of surfactant/leveling agent (preferably phenolphthalein). In addition, the present disclosure contemplates an electroplating bath made according to the above method.

The present disclosure further relates to an electroplating bath comprising water, an amount of a water-soluble gold-containing compound (preferably sodium tetrachloroaurate), first and second complexing agents (preferably sodium sulfite and 1-ascorbic acid), an amount of water-soluble tin-containing compound (preferably tin (II) chloride), an amount of buffer (preferably triammonium citrate), and preferably amounts of surfactant/leveling agents (preferably non-ionic Triton X-100 and phenolphthalein).

Still further, the present disclosure relates to a coating for mitigating tin whisker growth on a substrate surface comprising an amount of gold and tin co-deposited onto the substrate surface. According to a preferred variation, the gold and tin are electro-deposited onto the substrate surface, preferably to a thickness of from about 1 micron to about 10 microns. Preferably, the substrate surface comprises copper, and the gold is preferably co-deposited with the tin onto the substrate at a concentration of from about 0.5 to about 5 weight percent gold.

The present disclosure contemplates the described coatings as usefully coating any object, including, but in no way limited to, electronic components where it is desirable to mitigate the formation of tin whiskers by replacing a substantially pure tin-plated surface with a gold and tin plating. The present disclosure also contemplates the coatings and methods presented herein as useful in the manufacture of any object comprising electronic components that comprise the disclosed gold and tin platings.

BRIEF DESCRIPTION OF THE DRAWINGS

Figure 1A:
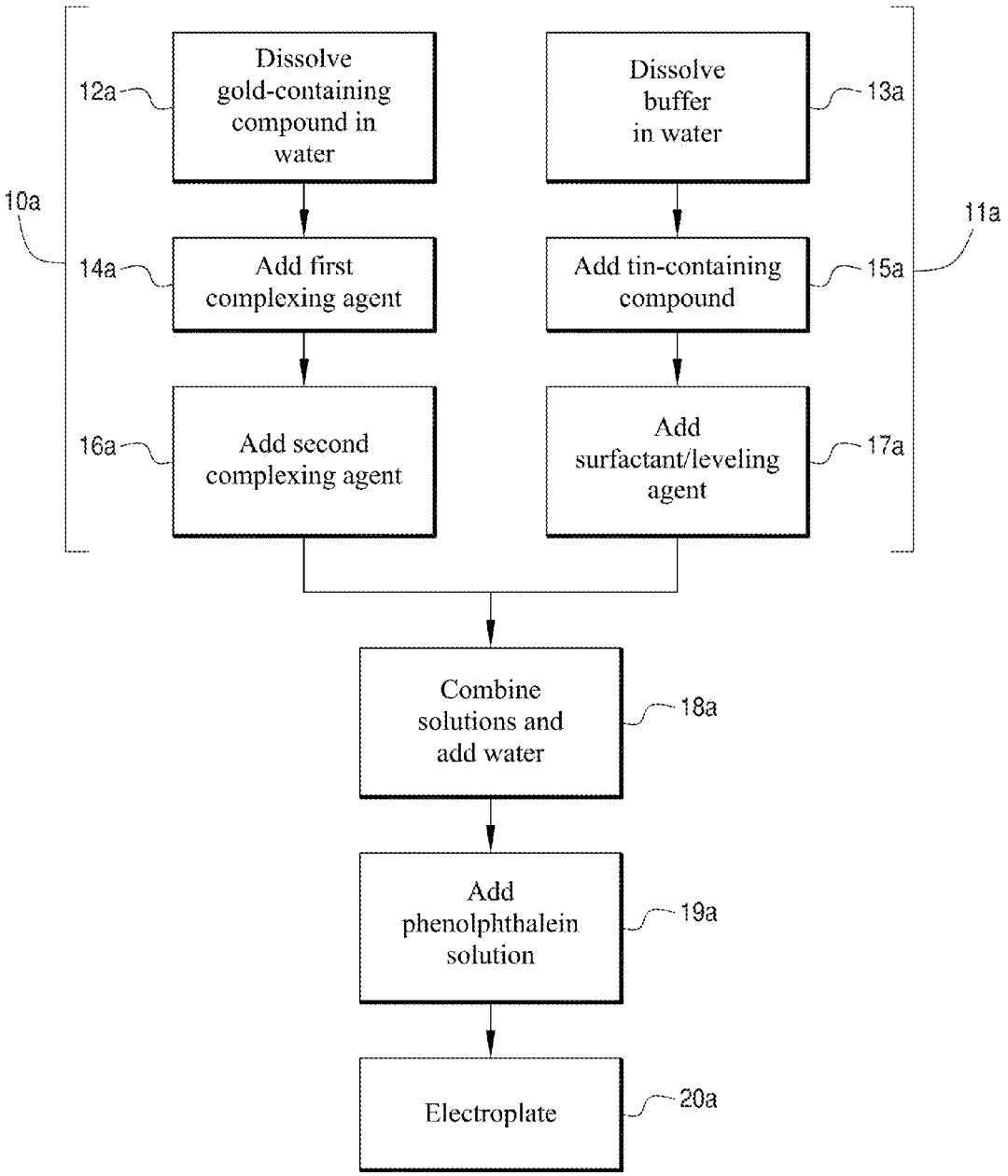
Figure 1B:
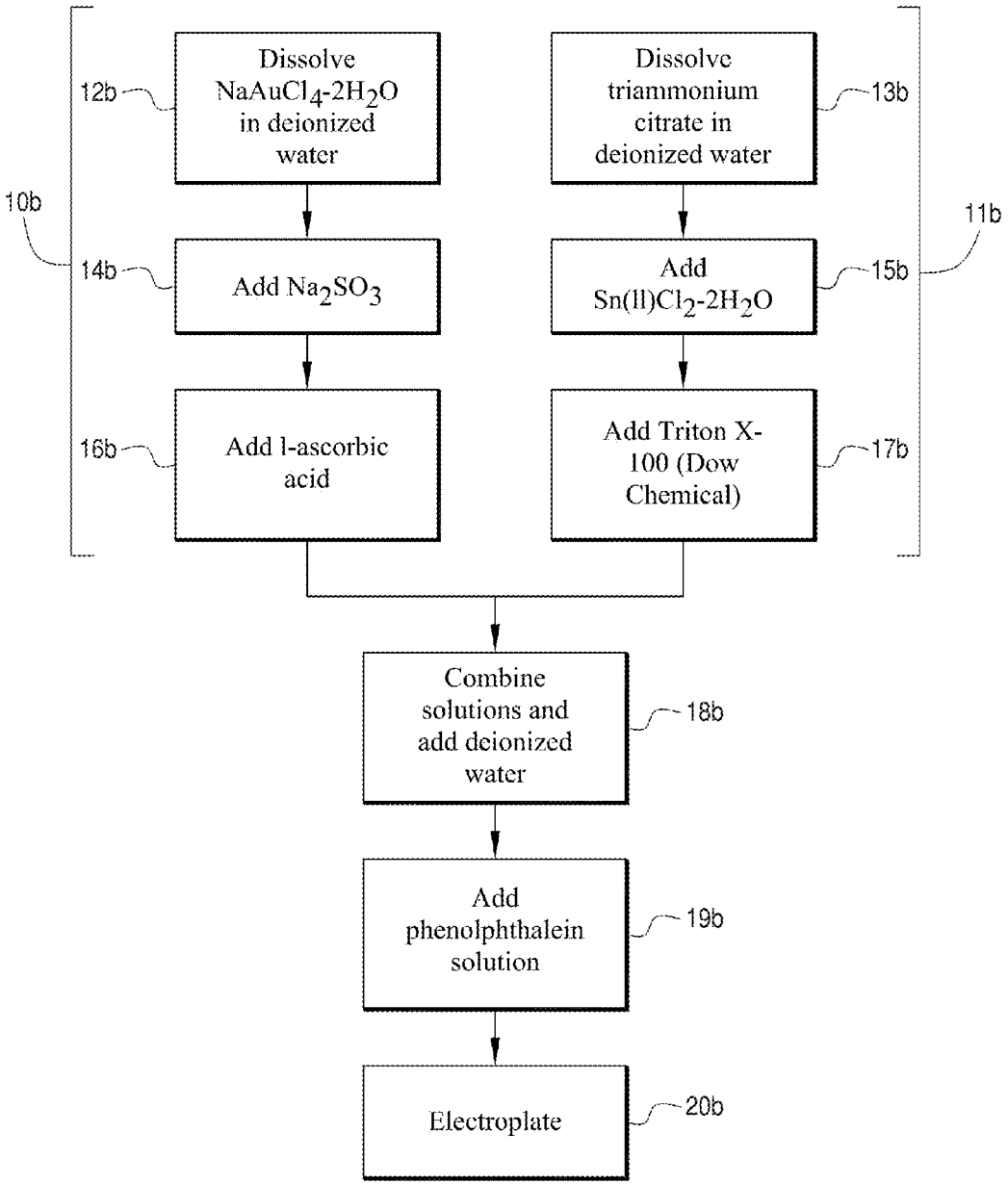
Figure 2:
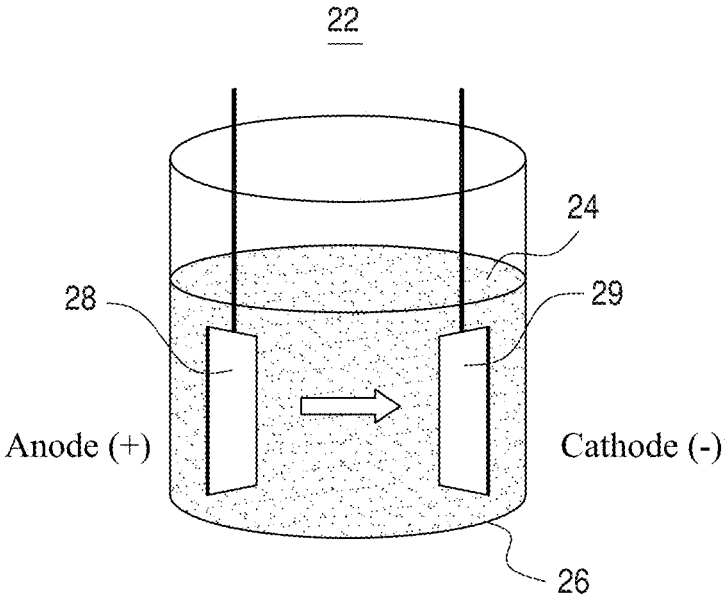
Figure 3:
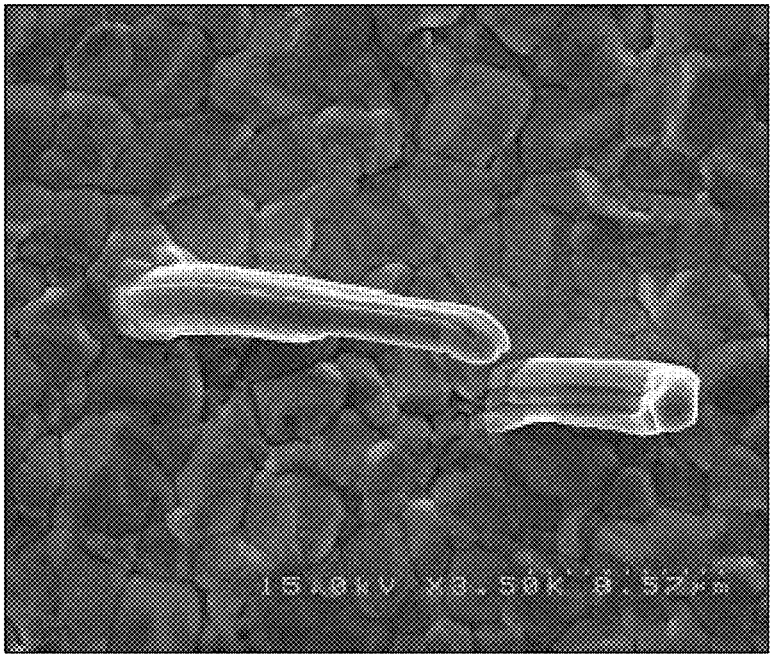
Figure 4:
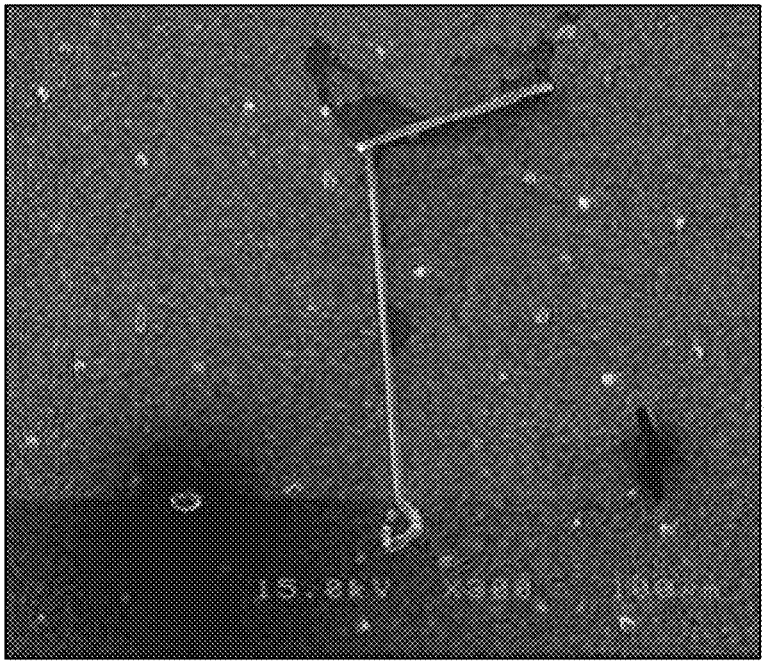
Figure 5:
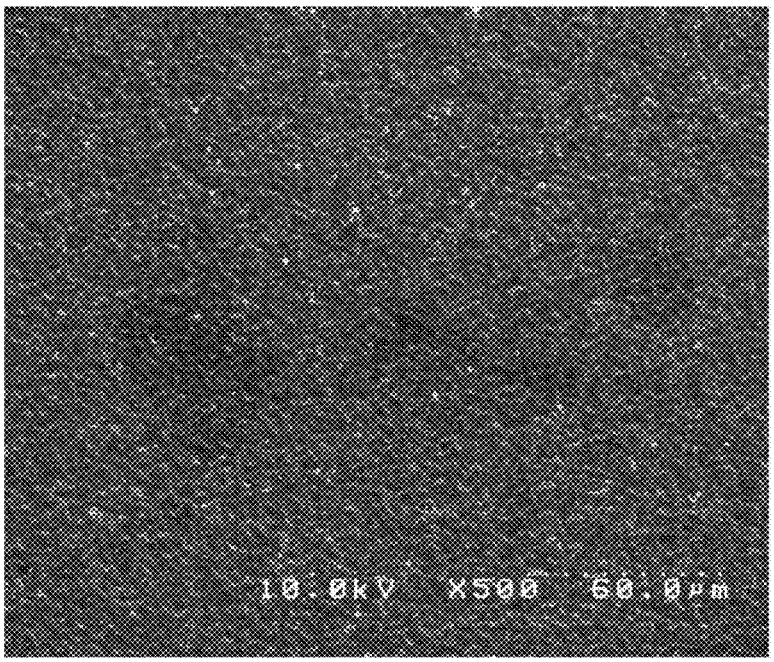
Figure 6:
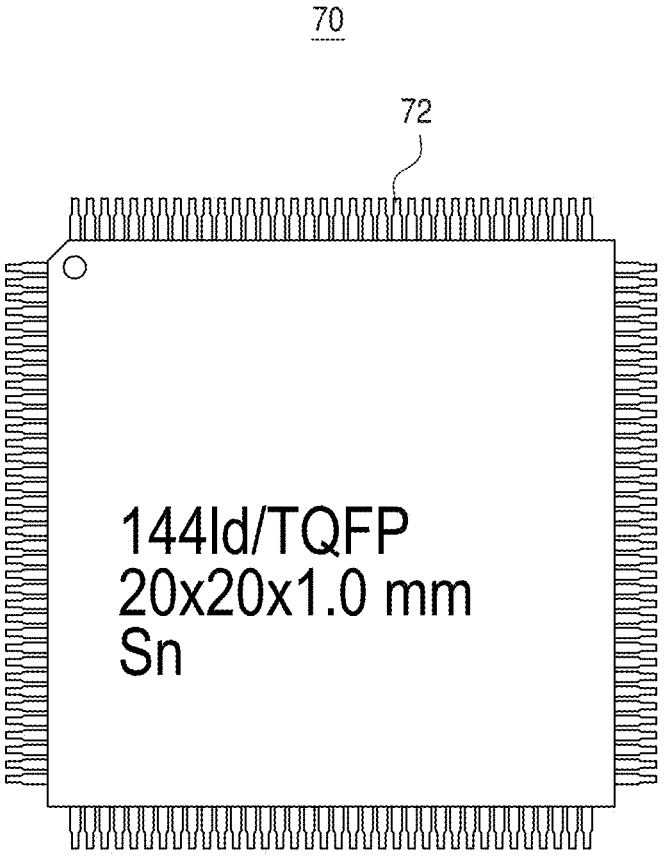
Figure 7:
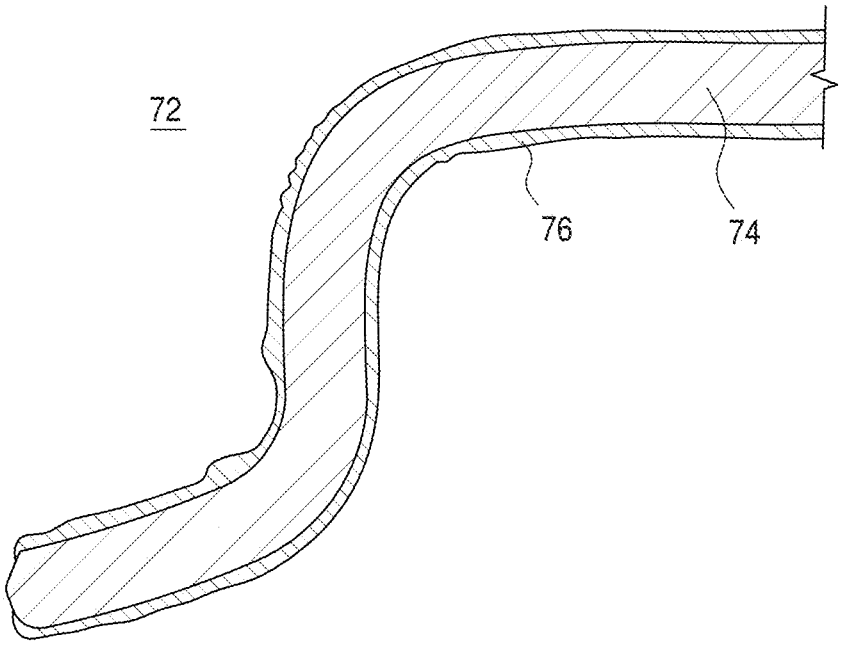

Having thus described variations of the disclosure in general terms, reference will now be made to the accompanying drawings, which are not necessarily drawn to scale, and wherein:

FIGS. 1*a* and 1*b* are flowcharts for preferred processes of plating a coating comprising gold and tin onto a substrate surface;

FIG. 2 is a schematic representation of a preferred electroplating bath for plating a gold and tin coating onto a substrate surface;

FIGS. 3 and 4 are micro-photographs of tin whiskers growing from a pure tin-plated substrate surface;

FIG. 5 is a micro-photograph of a surface coated with a plating comprising co-deposited gold and tin;

FIG. 6 is a schematic representation of an electronic component with tin-plated leads oriented along the perimeter of the component body; and FIG. 7 is a further enlarged schematic representation of a lead shown in FIG. 6.

DETAILED DESCRIPTION

The present disclosure relates to the development of electroplated tin films that are doped with controlled amounts of from about 0.5 to about 5 weight percent gold to suppress the growth of tin whiskers from the plated substrate surface, as otherwise commonly occurs with pure tin-plated substrates. The addition of controlled amounts of gold to tin-plated films has now been shown to significantly suppress and effectively eliminate undesired tin whisker growth for extended periods of time.

FIG. 1*a* shows a flow chart for a preferred variation of the present disclosure. According to the variation, a first electrolyte solution 10*a* and a second electrolyte solution 11*a* are prepared. To make solution 10*a*, in a first step 12*a*, an amount of a water-soluble gold-containing compound is dissolved in water. An amount of a first complexing agent for gold is added 14*a*, followed by adding an amount of a second complexing agent 16*a* as a complexing agent for tin. In the second solution 11*a*, an amount of buffer is dissolved in water 13*a*, followed by adding an amount of a water-soluble tin-containing compound 15*a*, and an amount of surfactant/leveling agent, 17*a*. The two solutions 10*a* and 11*a* are then combined with additional water 18*a*. An amount of phenolphthalein 19*a* is added to the solution. The resulting solution is then used as an electroplating solution to co-deposit tin and gold (from about 0.5 to about 5 weight percent, and more preferably from about 1 to about 2 weight percent gold) onto a substrate surface 20*a*.

FIG. 1*b* shows a flow chart for one preferred variation. According to the variation, a first electrolyte solution 10*b* and a second electrolyte solution 11*b* are prepared. To make solution 10*b*, in a first step 12*b*, an amount of a sodium tetrachloroaurate salt ($NaAuCl_4$-$2H_2O$) is dissolved in deionized water. An amount of sodium sulfite ($Na_2SO_3$) is added 14*b*, followed by adding an amount of 1-ascorbic acid 16*b* as a complexing agent for tin. In the second solution 11*b*, an amount of triammonium citrate buffer is dissolved in deionized water 13*b*, followed by adding an amount of tin (II) chloride ($Sn(II)Cl_2$-$2H_2O$) 15*b*, and an amount of Triton X-100, 17*b*. The two solutions 10*b* and 11*b* are then combined with the addition of deionized water 18*b*. An amount of phenolphthalein 19*b* is added to the solution. The resulting solution is then used as an electroplating solution to co-deposit tin and gold (from about 0.5 to about 5 weight percent, and more preferably from about 1 to about 2 weight percent gold) onto a substrate surface 20*b*.

As shown in FIG. 2, an electroplating bath 22 comprises container 26 comprising gold-containing tin electrolyte solution 24 into which is suspended an anode 28 (e.g. a pure tin anode, a tin and gold anode, etc.) and a cathode 29 (e.g. a copper or other metallic cathode, etc.). Stirring is provided, but not shown in FIG. 2.

Example 1

$NaAuCl_4$-$2H_2O$ (99%, Aldrich) in an amount of 0.111 grams was dissolved in 100 mls of deionized water in a beaker. An amount of 0.385 g of $Na_2SO_3$ (>98%, Aldrich) was dissolved into the $NaAuCl_4$ solution with stirring. An amount of 4.494 g of 1-ascorbic acid (>99%, Aldrich) was added to the above electrolyte solution with stirring to obtain a clear, very pale amber solution. In a separate beaker, 30.00 g of triammonium citrate (>97%, Aldrich) was dissolved in 150 mls of deionized water with stirring. An amount of 1.459 g of $Sn(II)Cl_2$-$2H_2O$ (Reagent grade, Alfa Aesar) was dissolved in the triammonium citrate solution with stirring. An amount of 0.250 g of Triton X-100 (Dow Chemical) was added to the tin-containing electrolyte solution and dissolved with stirring. The tin-containing electrolyte solution was then combined with the gold-containing electrolyte solution, with the total volume being brought up to 300 mls with deionized water. An amount of 0.304 g of a 0.5% phenolphthalein solution (Aldrich) was added drop-wise to the combined tin- and gold-containing solution with stirring. The pH of the solution was measured and found to be 5.4 (microfine pH paper).

Plating was conducted using 30 mls of the combined tin- and gold-containing electrolyte at 69° C. in a 50 ml glass beaker with stirring. The anode was constructed from tin sheet (99.998%, Aldrich). One coupon was plated at a time and fresh electrolyte was used for each sample (coupon) plated. Plating was conducted at 0.500 volts and 2.2 milliamps for 25 minutes to yield a light gray, satin matte plated film. The cathode was gently wiped every 5 minutes during the plating with a swab to remove fine particulates and gas bubbles. The tin electrode was cleaned using 500 grit SiC paper before each sample was plated. Fresh electrolyte was used for plating each sample. The first and seventh runs for the gold-doped tin films were analyzed by inductively coupled plasma (ICP) spectroscopy. The ICP spectroscopy results are shown in Table 1 below. Typically, the plated films were completely dissolved off the coupons using 8 mls of 1:1 nitric acid plus 4 mls of concentrated hydrochloric acid in a small beaker. This solution was then transferred to a 100 ml volumetric flask, diluted with deionized water, and analyzed for elements of interest using an ICP spectrometer.

TABLE 1

| Plated Film | ICP Analysis (First Coupon) | ICP Analysis (Last Coupon) | Plating Thickness (microns) | Roughness as Plated (Ra) (nm) | Roughness as Plated (TIR) (nm) | Average Grain Size (microns) | Grain Morphology |
|---|---|---|---|---|---|---|---|
| Sn | | | 4.9 | 105 | 725 | 2.88 | Columnar |
| SnAu | 1.0% Au | 1.3% Au | 2.2 | 60 | 330 | 1.92 | Columnar |

Pure tin-coated coupons were prepared for use as comparative control samples. This was achieved using the method developed by Yun Zhang (described in U.S. Pat. No. 5,750,017). Triton X-100 (Dow Chemical) in an amount of 0.1259 g was dissolved in 80 ml of deionized water. Methanesulfonic acid (70%, Aldrich) in an amount of 20 ml was added. Phenolphthalein solution (0.5%) (Aldrich) in an amount of 2.00 g was added dropwise while stirring. Tin methane sulfonate solution (50%, Aldrich) in an amount of 10 ml was added to the solution while stirring. Plating was conducted using 30 ml of the above electrolyte solution held at 50° C. in a 50 ml glass beaker while stirring. The anode was constructed from 99.998% tin sheet (Aldrich). Plating was performed at 0.045 V and 10.9 milliamps for 8 minutes to yield a gray satin plating.

Immediately after plating, the test specimens were put into a 50° C./50% relative humidity chamber in an effort to accelerate tin whisker formation and growth. Specimens plated with pure tin were also put into the test chamber for use as a control. At approximately 6 months, 12 months and 18 months, the test specimens were examined using a scanning electron microscope (SEM). The pure tin-plated films had numerous nodules and whiskers growing from the surface. See FIG. 3 (3500× magnification after 12,000 hours of aging) and FIG. 4 (300× magnification after 12,000 hours of aging). In strong contrast, the gold-doped tin plating had zero whiskers develop across the 1 $mm^2$ area evaluated over the same 6 month, 12 month and 18 month evaluation period. See FIG. 5 (500× magnification after 12,000 hours of aging).

As shown in the Example above, various surfactants can be added to the electrolyte solution containing the gold and tin. Preferred surfactants are non-ionic surfactants that act as leveling agents to help obtain a substantially uniform coating when plating onto a substrate. Preferred surfactants include Triton X-100, Igepal CA-630, Nonidet P-40, Conco NI, Dowfax 9N, Igepal CO, Makon, Neutronyx 600 series, Nonipol NO, Plytergent B, Renex 600 series, Solar NO, Sterox, Serfonic N, T-DET-N, Tergitol NP, Triton N, etc., with Triton X-100 being particularly preferred.

Without being bound to a particular theory, it is believed that the sodium sulfite serves to complex the gold ions as well as the tin ions in solution. The l-ascorbic acid complexes the tin in solution to prevent it from reacting with the water. In theory, two metals with different electromotive potentials cannot be practically plated at the same time. This limitation is usually overcome by chemically complexing one or both metals, which effectively brings their electromotive potentials closer together and allows them both to be plated/deposited at the same time. Other complexing agents that may work for the Sn/Au system include without limitation, citric acid, succinic acid, aspartic acid, EDTA, mannitol, or any organic compound with carboxylic acid groups, or other groups capable of complexing metal ions in solution, etc.

The gold-doped tin coatings made according to the preferred processes set forth in this disclosure are understood to be deposited onto a substrate of choice to a preferred thickness of from about 1 to about 50 microns, and more preferably to a thickness of from about 1 to about 10 microns, with a preferred gold concentration of from about 0.5 to about 5 weight percent, and more preferably from about 1 to about 2 weight percent. It is understood that the gold may be present in concentrations in excess of 5 weight percent, however, the tin whisker mitigation observed during 18 months of observation was achieved with gold concentrations of only about 1 weight percent. It is believed that excessive gold concentrations could impact the economic feasibility of the disclosed methods and coatings, without offering enhanced performance. In addition, the gold concentration must not interfere with the physical and chemical performance of the tin relative to, for example, soldering of the coated component, etc.

FIG. 6 shows an enlarged schematic view of a representative electronic component having tin-plated leads. As shown, component 70 is shown having tin-plated copper leads 72 about the periphery and extending from the body of component 70. FIG. 7 is a further enlargement of a cross-sectional view of a tin-plated copper lead 72 showing the copper 74 coated by a tin electroplate 76. It is understood that the electroplated coatings of the present disclosure will find utility relative to any and all electronic components and parts comprising copper or other metals where, for example, a tin coating would be required to make parts solderable, etc.

The examples presented herein contemplate use of the Sn/Au platings on objects including electronic components such as, for example, quad flat packs, plastic dual in-line packages (PDIPs), small-outline integrated circuits (SOICs), relays, etc., or as a plating for traces on printed circuit boards, etc. It is further contemplated that such electronic parts plated with the Sn/Au coatings of the present disclosure will find utility in any electronics systems used, for example, in any object such as aircraft, spacecraft, terrestrial or non-terrestrial vehicles, as well as stationary structures and other objects. A non-exhaustive list of contemplated vehicles include manned and unmanned aircraft, spacecraft, satellites, terrestrial, non-terrestrial and surface and subsurface water-borne vehicles, etc.

While the preferred variations and alternatives of the present disclosure have been illustrated and described, it will be appreciated that various changes and substitutions can be made therein without departing from the spirit and scope of the disclosure. Accordingly, the scope of the disclosure should only be limited by the accompanying claims and equivalents thereof.

We claim:

1. A method for mitigating tin whisker growth on a tin-plated substrate surface, the method comprising:

combining, in a first volume, a water-soluble gold-containing compound, water, a first complexing agent and a second complexing agent, by:

preparing a first solution by adding an amount of the water- soluble gold- containing compound to the water, adding the first complexing agent to the first solution, and adding the second complexing agent to the first solution;

combining, in a second volume separate from the first volume, a buffer, water, a water- soluble tin-containing compound, and a non-ionic surfactant/leveling agent, by:

preparing a second solution comprising an amount of the buffer dissolved in the water, adding the water-soluble tin-containing compound to the second solution, and adding an amount of the non-ionic surfactant/leveling agent to the second solution;

forming a third solution by combining the first solution containing the first complexing agent and the second complexing agent with the second solution containing the water-soluble tin-containing compound and the non-ionic surfactant/leveling agent, wherein the third solution comprises amounts of gold and tin ions in solution;

immersing an anodic electrode into the third solution;

immersing a cathodic substrate into the third solution, said cathodic substrate comprising a cathodic substrate surface;

connecting the anodic electrode and the cathodic substrate to an electrical power source capable of providing an electrical current;

activating the electrical power source to provide the electrical current to the anodic electrode, the cathodic substrate and the third solution; and co-depositing, from the third solution, an amount of gold and an amount of tin onto the cathodic substrate surface to a gold concentration of from about 0.5 to about 5 wt % gold;

wherein the co-deposited amount of gold and tin co-deposited onto the cathodic substrate surface provides a suitable surface for soldering; and wherein tin whisker formation on the cathodic substrate surface is mitigated.

2. The method of claim 1, wherein the gold-containing compound added to the water is a water-soluble gold salt.

3. The method of claim 1, wherein the gold-containing compound added to the water is sodium tetrachloroaurate.

4. The method of claim 1 wherein the tin-containing compound added to the second solution is a water soluble tin-containing salt.

5. The method of claim 1, wherein the tin-containing compound added to the second solution is tin (II) chloride.

6. The method of claim 1, wherein the first complexing agent is sodium sulfite.

7. The method of claim 1, wherein the second complexing agent is l-ascorbic acid.

8. The method of claim 1, wherein the buffer in the second solution comprises an amount of triammonium citrate.

9. The method of claim 1, wherein the third solution is maintained at a pH of about 5.4.

10. The method of claim 1, wherein the non-ionic surfactant/leveling agent comprises polyethylene glycol p-(1,1,3,3-tetramethylbutyl)-phenyl ether.

11. The method of claim 1, wherein the non-ionic surfactant/leveling agent comprises octylphenoxypolyethoxyethanol.

12. The method of claim 1, wherein the co-depositing forms a substantially uniform coating.

13. The method of claim 1, wherein the gold concentration is from about 0.5 to about 1.3 wt % gold.

14. The method of claim 1, wherein the gold concentration is from about 0.5 to about 1.0 wt % gold.

15. The method of claim 1, further comprising adding an amount of an additional surfactant/leveling agent that is different than the non-ionic surfactant/leveling agent to the third solution.

16. The method of claim 15, wherein the additional surfactant/leveling agent comprises phenolphthalein.

17. The method of claim 16, wherein the phenolphthalein functions as an additional leveling agent.

18. A method for mitigating tin whisker growth on a substrate surface, the method comprising:

preparing a first solution, the preparing of the first solution consisting essentially of:

dissolving an amount of a water-soluble gold-containing compound in a first volume of water, adding a first complexing agent to the first volume of water comprising the dissolved amount of the water-soluble gold-containing compound, and adding a second complexing agent to the first volume of water, comprising the dissolved amount of the water-soluble gold-containing compound;

preparing a second solution, the preparing of the second solution comprising:

dissolving an amount of triammonium citrate in a second volume of water, adding a water-soluble tin-containing compound to the second volume of water comprising the dissolved amount of the triammonium citrate, and adding an amount of surfactant/leveling agent to the second volume of water comprising the dissolved amount of the triammonium citrate and the added water-soluble tin-containing compound;

combining the first and second solutions to form a third solution;

immersing an anodic electrode into the third solution;

immersing a cathodic substrate into the third solution, said cathodic substrate comprising a cathodic substrate surface;

connecting the anodic electrode and the cathodic substrate to an electrical power source capable of providing an electrical current;

activating the electrical power source to provide the electrical current to the anodic electrode, the cathodic substrate and the third solution; and co-depositing, from the third solution, an amount of gold and an amount of tin onto the cathodic substrate surface to a gold concentration of from about 0.5 to about 5 wt % gold;

wherein the co-deposited amount of gold and tin co-deposited onto the cathodic substrate surface provides a suitable surface for soldering; and wherein tin whisker formation on the cathodic substrate surface is mitigated.

* * * * *